United States Patent [19]

DeBoer

[11] Patent Number: 4,772,582

[45] Date of Patent: Sep. 20, 1988

[54] SPACER BEAD LAYER FOR DYE-DONOR ELEMENT USED IN LASER-INDUCED THERMAL DYE TRANSFER

[75] Inventor: Charles D. DeBoer, Rochester, N.Y.

[73] Assignee: Eastman Kodak Company, Rochester, N.Y.

[21] Appl. No.: 136,073

[22] Filed: Dec. 21, 1987

[51] Int. Cl.[4] ..... B41M 5/035; B41M 5/26

[52] U.S. Cl. ..... 503/227; 8/471; 427/146; 427/256; 428/195; 428/206; 428/323; 428/327; 428/480; 428/913; 428/914; 430/201; 430/945

[58] Field of Search ..... 8/470, 471; 427/146, 427/256; 428/195, 206, 323, 327, 341, 480, 913, 914; 430/200, 201, 945; 503/227

[56] References Cited

U.S. PATENT DOCUMENTS 4,541,830 9/1985 Hotta et al. ..... 8/471

FOREIGN PATENT DOCUMENTS 163145 12/1985 European Pat. Off. ..... 503/227
2083726 3/1982 United Kingdom ..... 503/227

*Primary Examiner*—Bruce H. Hess
*Attorney, Agent, or Firm*—Harold E. Cole

[57] ABSTRACT

A dye-donor element for laser-induced thermal dye transfer comprising a support having thereon a dye layer and an infrared-absorbing material, and wherein the dye layer has a layer coated thereover which contains spacer beads of such particle size and concentration that effective contact between the dye-donor element and a dye-receiving element is prevented during the laser-induced thermal dye transfer.

20 Claims, No Drawings

SPACER BEAD LAYER FOR DYE-DONOR ELEMENT USED IN LASER-INDUCED THERMAL DYE TRANSFER

This invention relates to dye-donor elements used in laser-induced thermal dye transfer, and more particularly to the use of a spacer bead layer over the dye layer.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB No. 2,083,726A, the disclosure of which is hereby incorporated by reference.

There is a problem with using the laser system described above in that the transfer of dye tends to be nonuniform. In many instances, the dye-binder melts and sticks to the receiver, creating an effect called mottle. Further, when the dye-donor is in direct contact with the dye-receiving layer, heat is lost to the dye-receiving layer from the dye-donor, cooling the dye-donor with a resultant loss in density being transferred. It would be desirable to find a way to improve the uniformity and density of dye transfer using a laser.

U.S. Pat. No. 4,541,830 and EPA No. 163,145 describe a dye-donor for thermal dye transfer wherein the dye layer contains non-sublimable particles which protrude from the surface. Although there are no examples, there is a disclosure in these references that their donor could be used for high speed recording by a laser beam.

There is a problem with using non-sublimable particles in a dye layer of a dye-donor when a laser is used for dye transfer. High density areas, or drop-outs, tend to be formed causing undesirable graininess in the final print. It would be desirable to reduce or eliminate this problem.

Accordingly, this invention relates to a dye-donor element for laser-induced thermal dye transfer comprising a support having thereon a dye layer and an infrared-absorbing material, and wherein the dye layer has a layer coated thereover which contains spacer beads of such particle size and concentration that effective contact between the dye-donor element and a dye-receiving element is prevented during the laser-induced thermal dye transfer.

It is believed that by having the spacer beads in a separate layer over the dye layer, an air gap is created between the dye-donor and the receiver which helps to insulate the receiving layer from the dye-donor, thereby improving dye transfer. In addition, high density areas or drop-outs are reduced when the spacer beads are not in the dye layer, as will be shown by comparative tests hereinafter. It is believed that when spacer beads are in a dye layer, the dye tends to congregate around the beads during coating producing a high density area with no dye at the center. This problem is substantially reduced when the spacer beads are in a separate layer over the dye layer in accordance with this invention.

Any spacer beads may be employed in the invention provided they have the particle size and concentration as described above. In general, the spacer beads should have a particle size ranging from about 3 to about 100 $\mu$m, preferably from about 5 to about 50 $\mu$m. The coverage of the spacer beads may range from about 50 to about 100,000 beads/cm$^2$. In a preferred embodiment of the invention, the spacer beads have a particle size from of about 5 to about 50 $\mu$m and are present at a concentration of from about 60 to about 60,000/cm$^2$. The spacer beads do not have to be spherical and may be of any shape.

The spacer beads may be formed of polymers such as polystyrene, phenol resins, melamine resins, epoxy resins, silicone resins, polyethylene, polypropylene, polyesters, polyimides, etc.; metal oxides; minerals; inorganic salts; organic pigments; etc. In general, the spacer beads should be inert and insensitive to heat at the temperature of use.

The spacer beads may be coated with a polymeric binder to aid in physical handling. In general, good results have been obtained with binders such as higher polysaccharides e.g., starch, dextran, dextrin, corn syrup, etc.; cellulose derivatives; acrylic acid polymers; polyesters; polyvinylacetate; etc. The binder should be dye-permeable, insoluble to the spacer beads and dye and should be coated with a minimum amount so that the spacer beads project above the overcoat layer. In general, good results have been obtained at a concentration of about 0.002 to about 0.2 g/m$^2$.

Any material may be used as the infrared-absorbing material in the invention such as carbon black or non-volatile infrared-absorbing dyes or pigments which are well known to those skilled in the art. Cyanine infrared absorbing dyes may also be employed as described in DeBoer Application Ser. No. 136,074 filed of even date herewith entitled "Infrared Absorbing Cyanine Dyes For Dye-Donor Element Used In Laser-Induced Thermal Dye Transfer", the disclosure of which is hereby incorporated by references.

After the dyes are transferred to the receiver, the image may be thermally fused to stabilize the image. This may be done by radiant heating or by contact with heated rollers. The fusing step aids in preventing fading of the image upon exposure to light and also tends to prevent crystallization of the dyes. Solvent vapor fusing may also be used instead of thermal fusing.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.) and Aizen Malachite Green® (product of Hodogaya Chemical Co., Ltd.);

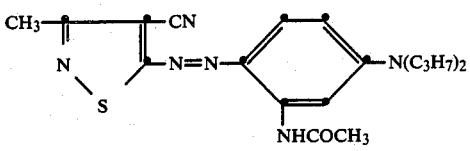

(magenta)

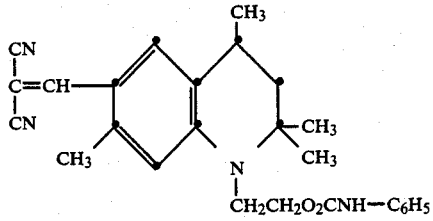

(yellow)

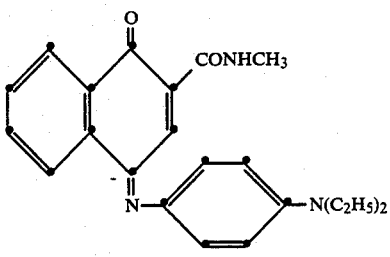

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element of the invention provided it is dimensionally stable and can withstand the heat generated by the laser beam. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers. The support generally has a thickness of from about 2 to about 250 μm. It may also be coated with a subbing layer, if desired.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek®.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above using a laser, and transferring a dye image to a dye-receiving element to form the dye transfer image.

The dye-donor element of the invention may be used in sheet form or in a continuous roll or ribbon. If a continuous roll or ribbon is employed, it may have only one dye thereon or may have alternating areas of different dyes, such as sublimable cyan, magenta, yellow, black, etc., as described in U.S. Pat. No. 4,541,830. Thus, one-, two- three- or four-color elements (or higher numbers also) are included within the scope of the invention.

In a preferred embodiment of the invention, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Several different kinds of lasers could conceivably be used to effect the thermal transfer of dye from a donor sheet to a receiver, such as ion gas lasers like argon and krypton; metal vapor lasers such as copper, gold, and cadmium; solid state lasers such as ruby or YAG; or diode lasers such as gallium arsenide emitting in the infrared region from 750 to 870 nm. However, in practice, the diode lasers offer substantial advantages in terms of their small size, low cost, stability, reliability, ruggedness, and ease of modulation. In practice, before any laser can be used to heat a dye-donor element, the laser radiation must be absorbed into the dye layer and converted to heat by a molecular process known as internal conversion. Thus, the construction of a useful dye layer will depend not only on the hue, sublimability and intensity of the image dye, but also on the ability of the dye layer to absorb the radiation and convert it to heat.

Lasers which can be used to transfer dye from the dye-donor elements of the invention are available commercially. There can be employed, for example, Laser Model SDL-2420-H2 ® from Spectrodiode Labs, or Laser Model SLD 304 V/W ® from Sony Corp.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is adjacent to and overlying the image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied using the laser beam. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

(A) A cyan dye-donor element in accordance with the invention was prepared by coating on a 100 μm gelatin-subbed poly(ethylene terephthalate) support:

(1) a dye layer containing the dyan dye illustrated above (0.33 g/m$^2$), the bis indolylcyanine dye illustrated below (0.16 g/m$^2$), and Dow Corning DC-510 ® surfactant (0.10 g/m$^2$) in a cellulose acetate propionate (2.5% acetyl, 45% propionyl) binder (0.30 g/m$^2$) coated from a toluene, methanol and cyclopentanone solvent mixture; and (2) an overcoat of a water suspension of polystyrene beads having the particle size indicated in the Table in a binder of Karo ® corn syrup (0.02 g/m$^2$) and Olin-Matheson 10G ® surfactant (0.02 g/m$^2$).

(B) A control dye-donor was prepared similar to (A) except that the spacer beads were incorporated into the dye layer itself.

(C) Another control dye-donor was prepared similar to (A) except that there was no overcoat layer.

(D) Other control dye-donors were prepared similar to (A) except that either the particle size of the spacer beads was too small or not enough spacer beads were present so that the dye-donor stuck to the receiver.

A dye-receiving element was prepared by coating a polyethylene-coated paper support with a dye-receiving layer of Uralac P-2504 ® (Scado Chem.) polyester (2.2 g/m$^2$).

The dye-receiving element was overlaid with the dye-donor placed on a drum and taped with just sufficient tension to be able to see the deformation of the surface beads and room dust and dirt. The assembly was then exposed on a 180 rpm rotating drum to a focused 830 nm laser beam from a Spectrodiode Labs Laser Model SDL-2420-H2 ® using a 30 μm spot diameter and an exposure time of 5 millisec. to transfer areas of dye to the receiver. The power level was 86 milliwatts and the exposure energy was 44 microwatts/sq. micron.

After dye transfer, the receivers were inspected for non-uniformities and relative grainy surface and for sticking of the donor to the receiver. The following results were obtained:

TABLE

| Dye Donor | Bead Size (μm) | Beads per cm$^2$ | Donor/Rec. Sticking | Graininess |
|---|---|---|---|---|
| B (cont.) | 8 | 8000 | No | Unacceptable |
| C (cont.) | — | none | Yes | * |
| D (cont.) | 5 | 20000 | Yes | * |
| A | 5 | 60000 | No | Moderate |
| A | 8 | 8000 | No | Moderate |
| A | 30 | 100 | No | Moderate |
| A | 30 | 300 | No | Moderate |
| D (cont.) | 50 | 20 | Yes | * |
| A | 50 | 60 | No | Moderate |

*Since the donor stuck to the receiver, transfer of dye was too non-uniform to estimate the relative graininess.

Infrared absorbing dye:

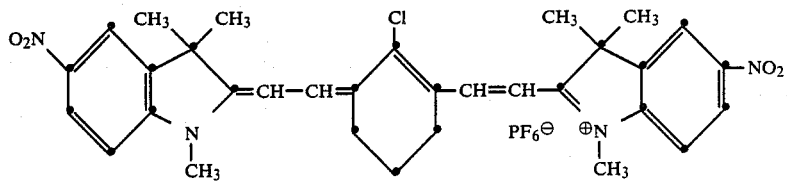

This dye is the subject of the Application Ser. No. 136074 filed Dec. 21, 1987 of DeBoer filed of even date herewith discussed above.

The above results indicate that graininess was unacceptable when the spacer beads were incorporated into the dye layer itself, and that sticking of the donor to the receiver occurred when there was no overcoat layer containing spacer beads or the spacer beads in an overcoat layer were not present in sufficient concentration or were not large enough. The dye-donor elements of the invention which had the spacer beads in an overcoat layer in sufficient concentration and particle size had improved graininess and did not stick to the receiver.

EXAMPLE 2

(A) A cyan dye-donor element in accordance with the invention was prepared by coating on a 100 μm gelatin-subbed poly(ethylene terephthalate) support:

(1) a dye laser containing the cyan dye illustrated above (0.33 g/m$^2$), the bis indolylcyanine infrared absorbing dye illustrated above in Example 1 (0.16 g/m$^2$), and Dow Corning DC-510® surfactant (0.10 g/m$^2$) in a cellulose acetate propionate (2.5% acetyl, 45% propionyl) binder (0.30 g/m$^2$) coated from a toluene, methanol and cyclopentanone solvent mixture; and (2) an overcoat of a water suspension of polystyrene beads having a particle size of 8 μm in a binder of white glue (a water based emulsion polymer of vinyl acetate (0.02 g/m$^2$) and Olin-Matheson 10G® surfactant (0.02 g/m$^2$).

(B) A control dye-donor was prepared similar to (A) except that there was no overcoat layer.

A dye-receiving element was prepared and processed with the donors as in Example 1.

After dye transfer, the receivers were inspected for non-uniformities and relative grainy surface and for sticking of the donor to the receiver. The print made from the control dye-donor B showed substantial non-uniformity and sticking, while the print from dye-donor A in accordance with the invention gave an acceptably uniform image.

The invention has been described in detail with particular reference to preferred embodiments thereof, but it will be understood that variations and modifications can be effected within the spirit and scope of the invention.

What is claimed is:

1. In a dye-donor element for laser-induced thermal dye transfer comprising a support having thereon a dye layer and an infrared-absorbing material, the improvement wherein said dye layer has a layer coated thereover which contains spacer beads of such particle size and concentration that effective contact between said dye-donor element and a dye-receiving element is prevented during said laser-induced thermal dye transfer.

2. The element of claim 1 wherein said spacer beads have a particle size of from about 3 to about 100 μm.

3. The element of claim 1 wherein said spacer beads are present at a concentration of from about 50 to about 100,000/cm$^2$.

4. The element of claim 1 wherein said spacer beads have a particle size from of about 5 to about 50 μm and are present at a concentration of from about 60 to about 60,000/cm$^2$.

5. The element of claim 1 wherein said spacer beads are polystyrene.

6. The element of claim 1 wherein said spacer beads are coated with a polymeric binder.

7. The element of claim 6 wherein said dye layer comprises sequential repeating areas of cyan, magenta and yellow dye.

8. In a process of forming a laser-induced thermal dye transfer image comprising (a) imagewise-heating by means of a laser a dye-donor element comprising a support having thereon a dye layer and an infrared-absorbing material, and (b) transferring a dye image to a dye-receiving element to form said laser-induced thermal dye transfer image, the improvement wherein said dye layer has a layer coated thereover which contains a binder and spacer beads of such particle size and concentration that effective contact between said dye-donor element and said dye-receiving element is prevented during said laser-induced thermal dye transfer.

9. The process of claim 8 wherein said spacer beads have a particle size of from about 3 to about 100 μm.

10. The process of claim 8 wherein said spacer beads are present at a concentration of from about 50 to about 100,000/cm$^2$.

11. The process of claim 8 wherein said spacer beads have a particle size from of about 5 to about 50 μm and are present at a concentration of from about 60 to about 60,000/cm$^2$.

12. The process of claim 8 wherein said spacer beads are polystyrene coated with a polymeric binder.

13. The process of claim 8 wherein said support is poly(ethylene terephthalate) which is coated with sequential repeating areas of cyan, magenta and yellow dye, and said process steps are sequentially performed for each color to obtain a three-color dye transfer image.

14. In a thermal dye transfer assemblage comprising:

(a) a dye-donor element comprising a support having a dye layer and an infrared absorbing material, and (b) a dye-receiving element comprising a support having thereon a dye image-receiving layer, said dye-receiving element being in a superposed relationship with said dye-donor element so that said dye layer is adjacent to said dye image-receiving layer, the improvement wherein said dye layer has a layer coated thereover which contains a binder and spacer beads of such particle size and concentration that effective contact between said dye-donor element and said dye-receiving element is prevented during laser-induced thermal dye transfer.

15. The assemblage of claim 14 wherein said spacer beads have a particle size of from about 3 to about 100 μm.

16. The assemblage of claim 14 wherein said spacer beads are present at a concentration of from about 50 to about 100,000/cm$^2$.

17. The assemblage of claim 14 wherein said spacer beads have a particle size from of about 5 to about 50 μm and are present at a concentration of from about 60 to about 60,000/cm$^2$.

18. The assemblage of claim 14 wherein said spacer beads are polystyrene.

19. The assemblage of claim 14 wherein said spacer beads are coated with a polymeric binder.

20. The assemblage of claim 14 wherein said support of the dye-donor element comprises poly(ethylene terephthalate) and said dye layer comprises sequential repeating areas of cyan, magenta and yellow dye.

* * * * *